US012345495B2

(12) United States Patent
Suman

(10) Patent No.: US 12,345,495 B2
(45) Date of Patent: Jul. 1, 2025

(54) METHOD OF MAKING A RELIABLE GUN

(71) Applicant: Andrew W. Suman, Waterford, MI (US)

(72) Inventor: Andrew W. Suman, Waterford, MI (US)

( * ) Notice: Subject to any disclaimer, the term of this patent is extended or adjusted under 35 U.S.C. 154(b) by 0 days.

(21) Appl. No.: 18/159,836

(22) Filed: Jan. 26, 2023

(65) Prior Publication Data

US 2023/0160653 A1 May 25, 2023

Related U.S. Application Data

(63) Continuation of application No. PCT/US2021/028704, filed on Apr. 22, 2021.
(Continued)

(51) Int. Cl.

| | |
|---|---|
| ***F41A 3/66*** | (2006.01) |
| ***C10M 171/00*** | (2006.01) |
| ***F41A 29/04*** | (2006.01) |
| *C10N 50/00* | (2006.01) |
| *F41A 3/12* | (2006.01) |
| *F41A 5/18* | (2006.01) |
| *F41A 19/13* | (2006.01) |

(52) U.S. Cl.
CPC ..... *F41A 29/04* (2013.01); *C10M 171/00* (2013.01); *C10N 2050/023* (2020.05); *F41A 3/12* (2013.01); *F41A 3/66* (2013.01); *F41A 5/18* (2013.01); *F41A 19/13* (2013.01)

(58) Field of Classification Search
None
See application file for complete search history.

(56) References Cited

U.S. PATENT DOCUMENTS 2,326,139 A * 8/1943 Green ..... F41A 21/26 89/14.5
2,504,162 A * 4/1950 Rhein ..... F41A 19/38 89/27.13

(Continued)

FOREIGN PATENT DOCUMENTS

| | | |
|---|---|---|
| WO | 2014107751 A1 | 7/2014 |
| WO | 2020076761 A1 | 4/2020 |
| WO | 2020106367 A1 | 5/2020 |

OTHER PUBLICATIONS

International Search Report & Written Opinion of the International Searching Authority dated Jul. 22, 2021 for International Application No. PCT/US2021/028704.

*Primary Examiner* — Derrick R Morgan
(74) *Attorney, Agent, or Firm* — Eschweiler & Potashnik, LLC

(57) ABSTRACT

A gun has parts that slide past one another during operation. A coating is formed on at least a surface of a first part that contacts a second part. At least an upper layer of the coating is porous and comprises a thermoset polymer and a filler. One or both parts may be part of a gas-operated reloading mechanism. The coating prevents jamming by excluding particles, yielding to particles that still manage to intrude, and by providing a reservoir for lubricant. The coating reduces clearances, improves accuracy, and reduces operating temperatures. The coating excludes particles from the lubricant, effectively allowing a large volume of lubricant to be used without the drawback of trapping dirt and other contaminants in the lubricant.

14 Claims, 5 Drawing Sheets

Related U.S. Application Data

(60) Provisional application No. 63/058,445, filed on Jul. 29, 2020.

(56) References Cited

U.S. PATENT DOCUMENTS 3,110,223 A * 11/1963 Schlappich ..... F41A 3/12 89/196
3,537,352 A * 11/1970 Joyce ..... F41A 19/56 124/31
3,808,129 A * 4/1974 Lindlof et al. ..... C08G 18/092 508/100
4,463,655 A * 8/1984 Krieger ..... F41C 27/00 89/196
4,623,472 A * 11/1986 Jamison ..... B29C 39/003 521/132
4,700,499 A * 10/1987 Knight ..... F41C 9/08 42/51
4,947,730 A * 8/1990 Byron ..... F41A 5/24 89/146
5,074,189 A * 12/1991 Kurtz ..... F41A 19/61 89/135
5,392,689 A * 2/1995 Buzzeo ..... F41A 3/86 89/196
6,782,650 B2 * 8/2004 McComas ..... F41A 21/22 205/255
7,767,631 B2 * 8/2010 Levy ..... C10M 111/04 508/156
7,871,078 B2 * 1/2011 Fischer ..... F16J 9/26 277/444
8,686,576 B1 * 4/2014 Smith ..... F03G 7/08 290/1 R
9,534,119 B2 * 1/2017 Suman ..... C09D 5/033
9,909,828 B1 * 3/2018 Klein ..... F41A 11/00
9,970,722 B1 * 5/2018 Babb ..... F41A 3/82
9,995,553 B1 * 6/2018 Oglesby ..... F41A 3/80
10,180,114 B1 * 1/2019 Maki ..... B05D 7/22
10,480,448 B2 * 11/2019 Maki ..... C23C 4/08
10,557,042 B2 * 2/2020 Lynn ..... C09D 5/14
10,704,856 B1 * 7/2020 Clyncke ..... F41C 3/00
10,775,125 B1 * 9/2020 Owen, Jr. ..... F41A 33/00
11,008,467 B2 * 5/2021 Tsukada ..... C09D 5/16
11,168,276 B2 * 11/2021 Larimer ..... C09D 7/40
11,385,010 B1 * 7/2022 Rofkahr, Jr. ..... F41A 19/10
11,512,920 B1 * 11/2022 Oglesby ..... F41A 17/42
11,524,152 B1 * 12/2022 Leeflang ..... A61M 25/0097
11,846,483 B1 * 12/2023 Smathers ..... F41A 3/66
2001/0014711 A1 * 8/2001 Levy ..... C10M 125/26 524/495
2002/0198113 A1 * 12/2002 Levy ..... C10M 111/04 508/100
2003/0192501 A1 * 10/2003 Ishikawa ..... F02F 1/20 123/193.2
2004/0111975 A1 * 6/2004 Suman ..... C09D 5/033 51/298
2005/0257413 A1 * 11/2005 Zimmermann ..... F42B 5/025 42/75.1
2007/0071990 A1 * 3/2007 Suman ..... C09D 5/032 428/548
2009/0279821 A1 * 11/2009 Liu ..... F16C 33/103 384/291
2010/0000400 A1 * 1/2010 Brown ..... F41G 1/02 42/111
2010/0008609 A1 * 1/2010 Chen ..... F16C 33/14 384/291
2010/0095837 A1 * 4/2010 Suman ..... C09D 5/033 524/588
2013/0015027 A1 * 1/2013 Miyasato ..... F16F 9/363 188/269
2013/0036900 A1 * 2/2013 Mueller ..... F41A 3/84 29/401.1
2014/0076144 A1 * 3/2014 Gomez ..... F41A 15/12 42/25
2014/0224114 A1 * 8/2014 Faxon ..... F41A 5/28 89/193
2015/0152270 A1 * 6/2015 Aizenberg ..... A61L 31/04 508/106
2016/0305738 A1 * 10/2016 Huang ..... F41C 23/20
2017/0160028 A1 * 6/2017 Martinez, Jr. ..... F41A 3/66
2017/0205196 A1 * 7/2017 Sheets, Jr. ..... F41A 3/66
2018/0087854 A1 * 3/2018 Gray ..... F41A 3/66
2018/0328682 A1 * 11/2018 Myers ..... F41A 3/80
2019/0055489 A1 * 2/2019 Bush ..... C10M 105/36
2020/0023503 A1 * 1/2020 Malak ..... B23P 15/00
2020/0348098 A1 * 11/2020 Galie ..... F41A 19/59
2021/0102780 A1 * 4/2021 Senff ..... F41C 23/18
2021/0222776 A1 * 7/2021 Suman ..... F16J 15/328
2021/0285736 A1 * 9/2021 Underwood ..... F41A 3/66
2022/0170713 A1 6/2022 Wilkinson
2022/0252366 A1 * 8/2022 Vaughan ..... F41A 17/42
2022/0316829 A1 * 10/2022 Vaughan ..... F41A 3/68
2023/0151852 A1 * 5/2023 Polanco ..... F16C 31/02 384/213
2023/0168056 A1 * 6/2023 Galie ..... F41A 17/06 42/69.03
2024/0133653 A1 * 4/2024 Dawson ..... F41A 29/04

* cited by examiner

METHOD OF MAKING A RELIABLE GUN

REFERENCE TO RELATED APPLICATIONS

This Application is a 371 continuation of PCT/US2021/028704, filed on Apr. 22, 2021, which claims the benefit of U.S. Provisional Application No. 63/058,445, filed on Jul. 29, 2020. The contents of the above-referenced patent applications are hereby incorporated by reference in their entirety.

BACKGROUND

A tradeoff between accuracy and reliability as running clearance varies has been observed for guns subjected to harsh operating environments or infrequent cleaning. Reducing running clearances improves accuracy. Increasing running clearances reduces jamming and other failures that result from contamination or abuse. This tradeoff has been exemplified by the Avtomat Kalashnikova (AK-47). The AK-47 has unusually wide clearances between moving parts, which make it highly resistant to jamming while limiting accuracy.

SUMMARY

One aspect of the present teachings is a gun having two parts configured to slide past one another during operation of the gun. In some embodiments, the parts are metal. In some embodiments, the parts have a telescoping relationship in the sense that the parts remain in contact as one part moves relative to the other in a straight line. In some embodiments, one or both parts are part of a gas-operated reloading mechanism. According to the invention, a coating is formed on at least a surface of the first part that contacts the second part. At least an upper layer of the coating is porous and comprises a thermoset polymer and a filler.

The porous upper layer provides a reservoir for lubricant. Through capillary action and the like, the coating may retain a lubricant over the part surface in a volume per unit area greater than would be possible without the coating, particularly if the lubricant has a low viscosity. Without the coating, the excess lubricant would flow away from the part surface. The property of retaining low viscosity lubricant is particularly beneficial for preventing jamming of a gun that is intermittently subjected to arctic conditions. In some embodiments, the upper layer has a porosity in the range from 2% to 80%. In some embodiments, the upper layer has an interconnectivity above a percolation threshold.

In some embodiments, the coating undergoes compression and expresses oil during firing of the gun. The compression may bring lubricant to the surface of the coating, whereby there is a liquid lubricant film between the mating parts. The coating is resilient under this type of compression. Between firings, the coating may reabsorb some of the expressed lubricant. This property further contributes to the maintenance of lubrication under diverse conditions. Moreover, the expression and reabsorption of oil from the porous upper surface may be operative to filter the lubricant.

In some embodiments, the filler is present in an amount from 15 to 40 percent by volume of solid material in the upper layer. In some embodiment, the upper layer is formed from a powder of particles that individually have the filler in an amount from 15% to 40% by volume. If there is too little filler, the coating may not have the desired wear properties. If there is too much filler, the coating may be difficult to process. In some embodiments, the filler is a dry film lubricant. This further ensures that lubrication is maintained under a wider range of operating conditions.

The coating may be applied relatively thickly. In some embodiments, the coating is applied to form an interference fit during initial assembly of the gun. In some embodiments, the coating has a thickness of 100 μm or more over at least a portion of the part surface. In some embodiments, the coating has a thickness of 300 μm or more over at least a portion of the part surface. The coating may shear during assembly and may wear during operation with thermal cycling to provide a nearly perfect fit.

The coating is operative to prevent jamming by sand and other debris. The coating narrows clearances to exclude the entry of particles into the space between the moving parts. The coating is abradable. If particles do work their way between the parts, the coating will abrade to make room for the particles before they can cause a jam. The coating is friable to the extent that the coating will abrade as necessary to accommodate the particle without flaking or coming off in chunks.

The narrowed clearances with sustained lubrication and jamming prevention provide several additional benefits. Operation is smoother operation, accuracy is improved, and noise and vibration are reduced. Operating temperatures are lowered. There is less friction and less wear.

In some embodiments, the upper layer comprises particles adhered to one another with spaces in between. In some embodiments, that structure is formed by curing particles containing a thermosetting resin and the filler in such a way that the particles sinter but do not flow sufficiently to entirely lose their discrete identities. In some embodiments, a powder of the particles is applied to the part surface by electrostatic deposition. In some embodiments, the powder is formed from a process that includes melt-mixing the thermosetting resin and the filler material to form a composite, cooling the composite, and breaking up the cooled composite to form the powder. In some embodiments, the filler is graphite although many other fillers may be used.

In some embodiments, the coating further comprises a non-porous lower layer comprising a second thermoset polymer. In some embodiments, the lower layer is derived from a liquid comprising a second thermosetting resin. The liquid is applied to the surface prior to coating with the powder. In some embodiments, the powder is applied over the liquid prior to drying or curing the liquid. The powder and the liquid are cured together to form the coating. The liquid may form a nonporous layer proximate the surface while the powder forms the porous upper layer. The lower layer improves adhesion and wear properties of the coating particularly where the coating is subject to mechanical load.

The primary purpose of this summary has been to present certain of the inventor's concepts in a simplified form to facilitate understanding of the more detailed description that follows. This summary is not a comprehensive description of every one of the inventor's concepts or every combination of the inventor's concepts that can be considered "invention". Other concepts of the inventor's will be conveyed to one of ordinary skill in the art by the following detailed description together with the drawings. The specifics disclosed herein may be generalized, narrowed, and combined in various ways with the ultimate statement of what the inventor claims as his invention being reserved for the claims that follow.

DETAILED DESCRIPTION

Figure 1:
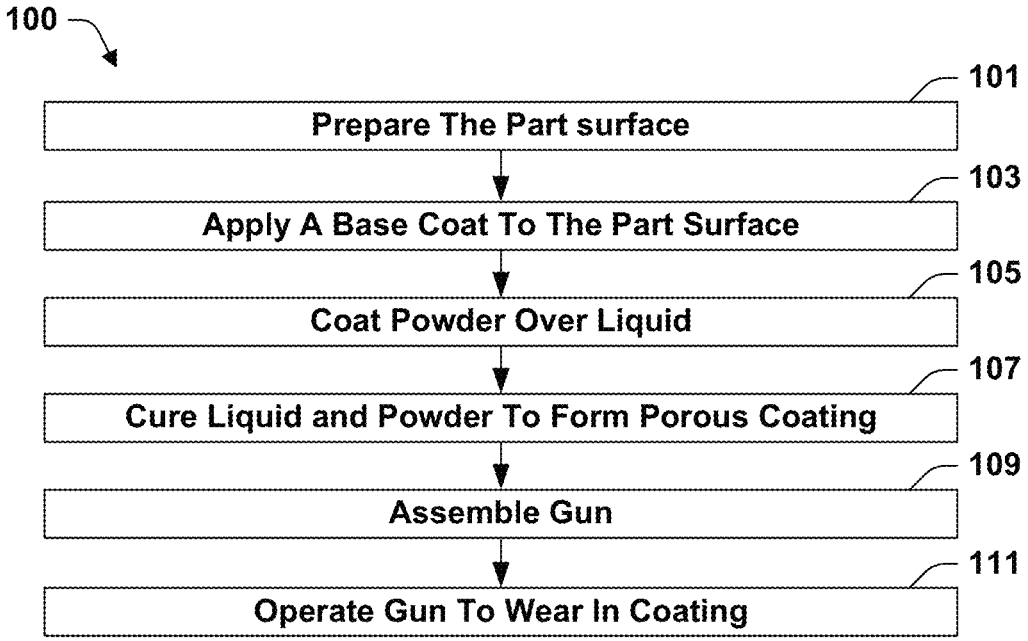
FIG. 1 is a flow chart of a process for coating a gun part in accordance with some aspects of the present teachings.

FIG. 1 is a flow chart of an example process 100 for forming a gun part with a coating according to the present disclosure. Act 101 is preparing the part that will receive the coating. Examples of parts that may be coated include, without limitation, a bolt, a bolt carrier, a firing pin, a barrel, a receivers, a gas key, a gas tube, any other part of the bolt carrier group, and any other moving part associated with a gas-powered reloading mechanism. The part can be of any material that can withstand the cure temperature of the coating. In some embodiments, the part is metal. The surface to be coated may already have a coating, porous or non-porous, of any suitable material.

Preparing the part surface is optional, although generally advisable. Any surface preparation process or combination of processes may be employed. Examples of surface preparation processes that may be used include physical and chemical processes. Examples of physical preparation processes include, without limitation, vibro-finishing, sanding, abrasive grit blasting, media blasting, plasma treatment, irradiative treatment, and the like. Examples of chemical preparation processes include, without limitation, washing, activating, sealing, and the like. The surface preparation process may form a coating on the surface by chemical, electrochemical, or other means. In some embodiments, surface preparation produces a conversion coating. Examples of conversion coatings include phosphate coatings, chromate coatings, black oxide, and the like. Surface preparation may include electroless plating or electroplating to form alloys of nickel, chrome, tin, or other metals. Surface preparation may include galvanizing.

Act 103 is applying a base coat to the part surface. The base coat is a liquid composition that includes a thermosetting resin. The thermosetting resin may be part of a resin system that includes one or more of a curing agent, a hardener, an inhibitor, and plasticizer. Any suitable thermosetting resin may be used. Examples of thermosetting resins that may be used include acrylic, allyl, benzoxazine, epoxy, benzoxy melamine formaldehyde, phenolic, polyamide, polyaryl sulphone, polyamide-imide, polybutadiene, polycarbonate, polydicyclopentadiene, polyester, polyphenylene sulphide, polyurethane, silicone, and vinyl ester resins and mixtures thereof. The thermosetting resin may make up 35% or more of the liquid by volume.

Optionally, the base coat includes a solvent. The solvent is present in at least an amount sufficient to make the composition liquid if a solvent is needed for that purpose. Low boiling point solvents are preferred as are organic solvents. Examples of solvents that may be suitable for the liquid primer include methyl ethyl ketone (MEK), N-Methyl-2-pyrrolidone (NMP), turpentine, xylene, mineral spirits, turpenoid, toluene, dimethylfomamide, glycol ethers, ethylbenzene, n-butyl acetate, alcohols, acetone and combination thereof. In some embodiments, the base coat includes one or more epoxy resins that remain liquid without solvent.

The base coat may include other components such as diluents, surfactants, modifiers, and other components that either contribute to the formation of the base layer or the functionality of the final coating. Examples of other components that may contribute to the formation of the base layer include, without limitation, curing agents, hardeners, inhibitors, and plasticizers. Examples of other components that may contribute the functionality of the coating include, without limitation, pigments and minerals of various types such as graphite, hexagonal boron nitride, talc, other clays, minerals between 1 and 10 on the scale of MOH's hardness, diamond, cubic boron nitride, metal flake, and the like.

The base coat may be formed by any suitable process. Depending on the composition of the base coat and the material of the gun part, suitable processes may include spraying, electrostatic deposition, silk screening, dipping, ink jet printing, brushing, dip spinning, pad printing, film transferring, wiping, and the like. In some embodiments, the process includes some type of spraying. Spraying may be electrostatic spraying. Also, the gun part may be spun during or after spray deposition. The base coat may be formed with multiple layers and the layers may be of different materials.

An additional process may take place after the initial application of the base coat to improve uniformity or coverage. The additional process may include wiping, rinsing, or flinging excess base coat material from the surface. In some embodiments, centripetal force is used to fling excess base coat material from the surface. Centripetal force can be effective in producing a highly uniform base coat.

Act 105 is depositing the powder over the liquid base coat. The powder includes a thermosetting resin and a filler. The thermosetting resin of the powder may be part of a resin system that includes one or more of a curing agent, a hardener, an inhibitor, and a plasticizer. Any suitable thermosetting resin may be used. A thermosetting resin is any polymer resin that can be irreversibly hardened by curing regardless of whether curing is induced by heat, radiation, pressure, catalysis, or any other mechanism. In some embodiments, the thermosetting resin is of a type that can be granulated into a powder. Examples of thermosetting resins that may be used include, without limitation, acrylic, allyl, allyl, benzoxazine, epoxy, melamine formaldehyde, phenolic, polyamide, polyaryl sulphone, polyamide-imide, polybutadiene, polycarbonate, polydicyclopentadiene, polyester, polyphenylene sulphide, polyurethane, silicone, and vinyl ester resins and mixtures thereof. In some embodiments, the powder has the resin in an amount that is 35 percent or more by volume.

The filler material preferably has a melting point above a cure temperature of the thermosetting resin. In some of these teachings, the filler material is a solid lubricant. Examples of solid lubricants that may be used as the filler material include graphite, PTFE, polyamide, polyamide imide, polyimide, boron nitride, carbon monofluoride, molybdenum disulphide, talc, mica, kaolin, the sulfides, selenides, and tellurides of molybdenum, tungsten, or titanium and combinations thereof. The mixture preferably has the filler material in an amount that is 15 to 40 percent by volume. In some of these teachings the filler is at least 60 percent graphite. In some of these teachings the graphite particles have lengths in the range from 7 to 30 micrometers. Some application benefit from the inclusion of clay in the filler. In some of these teachings, the filler is from 20% to 40% clay by volume. Examples of clays that are suitable for the filler include kaolin, mullite, montmorillonite, and bentonite.

Figure 2:
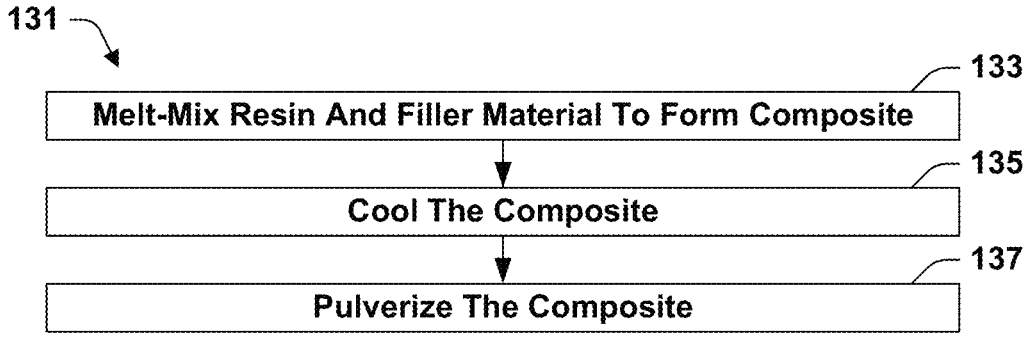
FIG. 2 is flow chart of a process that may be used in accordance with some aspects of the present teachings to form a powder.

The powder may be the product of a process 131, which is illustrated by FIG. 2. The process 131 includes act 133, melt-mixing the polymer resin and the filler to form a composite, act 135, cooling the composite, and act 137, breaking up the composite to form a powder. The composite may be broken up to form the powder by any suitable process such as milling or the like. The resulting powder preferably has a mean particle size in the range from 2 to 200 μm. For purposes of the present disclosure, particle sizes are the diameters of spheres having the same volume as the particles. More preferably, the mean particle size is in the range from 5 to 150 μm. Still more preferably the particle size is in the range from 10 to 80 μm. Smaller particles may be difficult to process. Larger particles may not adhere well when electrostatics are used. Preferably, the filler and the resin are both present in the individual particles of the powder.

The powder may be deposited over the liquid by any suitable process. In some embodiments, the coating process comprises electrostatics, e.g., electrostatic spray deposition. More generally, the coating process may include one or more of spraying the powder, fluidizing the powder, heating the powder, and heating the surface to be coated. If the surface is heated, it is not heated in a way that solidifies the base layer. It may also be feasible to apply the powder by dipping, rolling, screen printing, or other film transfer process. The powder may be formed into a slurry to facilitate use in one of the foregoing processes.

In some embodiments, act 105 includes depositing multiple layers. Each layer may comprise a different type of powder. The powders may vary in composition, size distribution, or any other characteristic. The different layers may be used in combination to provide desirable wear characteristics and the like. For example, differing powder composition may be used to provide a low wear resistance upper layer and a second that produces a higher resistance layer underneath. A variety of parameters may be adjusted to produce a desired degree of wear resistance. Useful parameters to adjust include the identity of the thermosetting resin, the cure temperature, the amount of filler, the composition of the filler including the amount of clay the filler contains, and the porosity of the coating, which may be controlled through the size distribution of the dry powder particles.

Act 107 is curing the base layer and the powder to form the coating. Curing evaporates any solvent from the base layer and hardens the base layer. Curing may be driven by any of heat, radiation, pressure, catalysis, combinations thereof, or any other mechanism. Where curing is driven by heat, heating may take place by convection, conduction, induction, radiative heating, combinations thereof, or any other mechanism. In some embodiments, curing causes the powder to sinter, but curing completes without the particles flowing sufficiently to lose their discrete identities. In some embodiments, curing takes place in a temperature range between 100° C. and 300° C. In some embodiments, curing takes place in a temperature range between 150° C. and 200° C. Curing solidifies the coating. Curing may also consolidate or densify the coating. The various layers of the coating may be cured simultaneously or sequentially.

Figure 3:
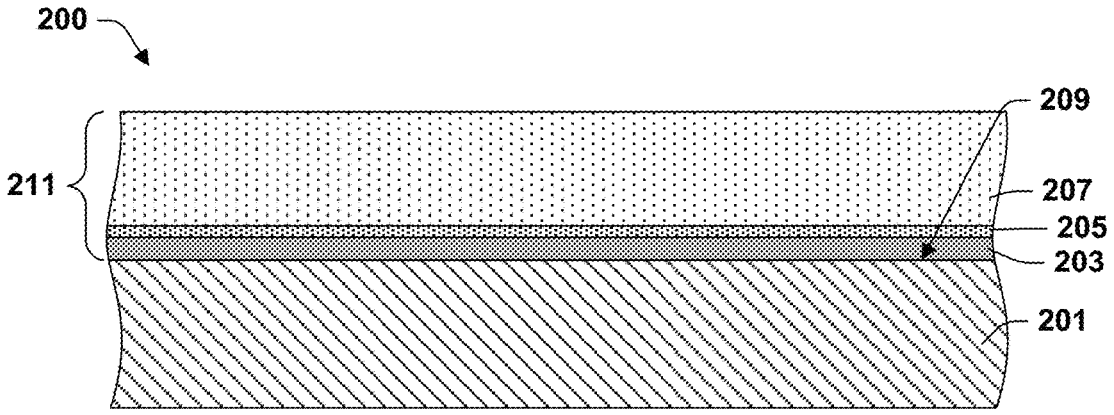
FIG. 3 is a sketch of a part surface with a coating in accordance with some aspects of the present teachings.

FIG. 3 illustrates a coated part 200 that may be a product of the process of FIG. 1. The coated part 200 includes a metal part 201 and a coating 211 formed on a surface 209 of the metal part 201. The abradable coating 211 includes a base layer 203 formed from a liquid coat, an upper layer 207 formed from powder particles, and an interfacial area 205 formed from both the liquid coat and the powder particles.

The base layer 203 is generally non-percolating in the sense that neither liquid nor air can pass through it. In some embodiments, the base layer has 5% or less porosity. In some embodiments, the base layer has 2% or less porosity. In some embodiments, the base layer has no porosity. The base layer 203 includes a thermoset polymer matrix and may include one or more non-polymer materials dispersed within the thermoset polymer matrix. The base layer 203 adheres the coating 211 to the surface 209 and may serve other functions such as providing corrosion resistance, sealing, and the like for the surface 209.

In some embodiments, the upper layer 207 has an interconnectivity above a percolation threshold meaning that fluids can pass through it. The porosity of the upper layer 207 may be in the range from 2 to 80 percent. In some embodiments, the porosity of the upper layer 207 is in the range from 2 to 40 percent. In some embodiments, the porosity of the upper layer 207 is in the range from 2 to 20 percent. The porosity may facilitate the provision of controlled wear properties, desirable rheological properties, and a reservoir of lubricating fluid. The provision of porosity in the upper layer 207 is facilitated by curing without allowing excessive flow, whereby in some embodiments individual particles of the powder from which the upper layer 207 was formed remain identifiable within the upper layer 207. The upper layer 207 may provide the coating 211 with targeted characteristics such as, for example, friability, lubricity, clearance control capability, heat transport, and the like. In some embodiments, the upper layer 207 is two or more times thicker than the base layer 203.

The thickness of the coating 211 may vary over the coated part 200. The coating 211 may be very thick on the coated part 200. In some embodiments, at its thickest point, the coating 211 may have a thickness the coating has a thickness of 100 μm or greater. In some embodiments, the coating 211 has a maximum thickness of 300 μm or greater. In some embodiments, the coating 211 has a maximum thickness of 500 μm or greater. A thickness of 750 μm has been demonstrated and thicker coatings are possible. The thickness is generally at least about 25 μm.

In some embodiments, the upper layer 207 includes multiple strata (sublayers) composed of different types of particles. The different strata may be used to control characteristics of the coating. For example, the upper layer 207 may include an upper strata that wears relatively quickly and a lower strata that is comparatively wear resistant to provide a balance between easy break-in and long life.

The interfacial area 205 includes particles of the upper layer 207 partially surrounded or entirely surrounded, partially sunken or entirely sunken, into the polymer matrix of the base layer 203. Fluid-solid interactions may cause the formation of a complex interface. The interfacial area provides adhesion between the upper layer 207 and the base layer 203.

Figure 4:
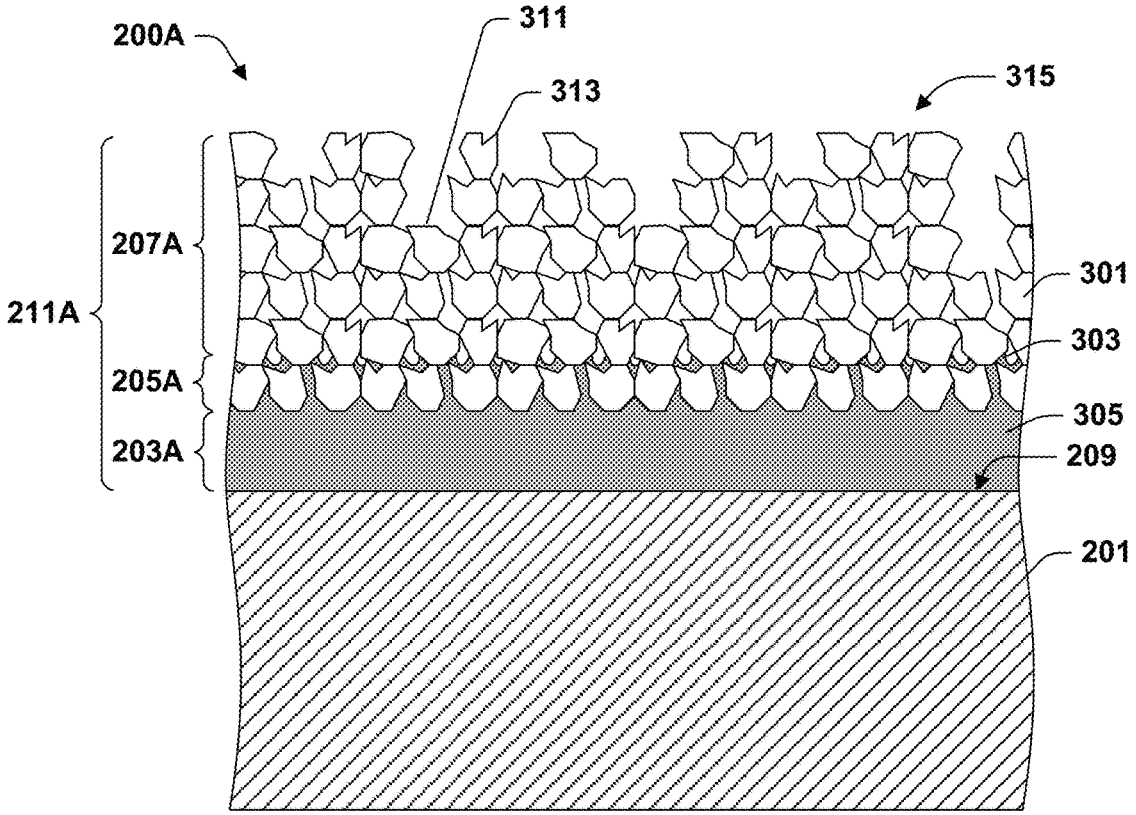
FIG. 4 is another sketch of a part surface with a coating in accordance with some aspects of the present teachings.

FIG. 4 is a sketch of a coated part 200A, which is an example of the coated part 200 and illustrates a possible structure. The coated part 200A includes the coated part 201 and an abradable coating 211A formed on the surface 209 of the coated part 201. The abradable coating 211A includes a non-porous base layer 203A formed from a liquid coat, a porous upper layer 207A formed from powder particles, and an interfacial area 205A formed from both the liquid coat and the powder particles.

The upper layer 207A includes particles 301 that have been sintered enough to flow and bind together to form a solid mass. An upper surface 315 of the mass may include peaks 313 and valleys 311. The base layer 203A includes a polymer matrix 305. The interfacial area 205A includes particles 301 that are bound by the polymer matrix 305. Some particles 301 may be completely immersed in the polymer matrix 305. Other particles 301 may be partially surrounded by the polymer matrix 305. The particles 301 and the polymer matrix 305 may have a complex interface due to interactions of the liquid base layer and particles of the powder. In some embodiments, those interaction result in a contact structure 303 that is partially determined by a contact angle between the liquid base coat and particles of the powder. FIG. 4 illustrates a structure that may form when the base coat is wetting with respect to the powder particles.

Returning to FIG. 1, the process 100 may continue with a break-in process that determines a final shape for the coating 211. Act 109 is assembling a gun with the part 200. The part 200 may form an interference fit with another part (not shown) of the gun. The coating 211 may initially be thicker than the clearance between the mating parts, whereby a portion of the coating 211 is necessarily shaved off when the gun is initially assembled.

Act 111 is operating the gun. Operation causes wear at high stress points on the coating 211. As the wear progress, a contact area between the mating parts tends to increase and clearances become optimized, which effects reduce local stresses until the shape of the coating 211 stabilizes.

Before break-in, the upper surface 315 has a roughness that is related to a structure of the particles 301. In particular, because the abradable coating 211 cures without the particles 301 flowing sufficiently to entirely loose their discrete identities, the upper surface 315 has peaks 313 that individually correspond to one or more of the particles 301. In some embodiments, before break-in, the upper surface 315 has a roughness Ra in the range from about 0.5 μm to about 20 μm. In some embodiments, before break-in, the upper surface 315 has a roughness Ra in the range from about 1 μm to about 10 μm. In some embodiments, before break-in, the upper surface 315 has a roughness Ra greater than about 2 μm.

After break-in, the upper surface 315 may be smoother. Nevertheless, in some embodiment the upper surface 315 continues to have roughness that relates to the particles 301 retaining a degree of separation. Asperities on the upper surface 315 may be reduced by wear and the surface 315 may recede, but in some embodiments valleys 311 between particles 301 continue to appear of the upper surface 315. In some embodiments, after break-in, the upper surface 315 has a roughness Ra in the range from about 0.2 μm to about 10 μm. In some embodiments, after break-in, the upper surface 315 has a roughness Ra in the range from about 0.5 μm to about 5 μm. In some embodiments, after break-in, the upper surface 315 has a roughness Ra greater than about 1 μm.

The removal of asperities from the upper surface 315 and the appearance of new values 311 as wear continues may result in the valleys 311 having a greater contribution to surface roughness than the peaks 313. This effect is captured by the Rsk of the surface, the Rsk being a roughness parameter that measures the skewness of the of a surface height distribution about a mean. In some embodiments, prior to break-in, the Rsk of the upper surface 315 is in the range from −0.5 to 0.5. In some embodiments, prior to break-in, the Rsk of the upper surface 315 is in the range from −0.25 to 0.25. After break-in these Rsk values are reduced. In some embodiments, after break-in reduces the Rsk be about −0.5 or more. In some embodiments, after break-in, the Rsk is less than about −0.25. In some embodiments, after break-in, the Rsk is less than about −0.50. In some embodiments, after break-in, the Rsk is less than about −1.0.

A structure of the upper surface 315 may also be characterized in terms of the roughness parameters Reduced Peak Height (Rpk) and Reduced Valley Depth (Rvk). Rpk relates to peak height over a surface mean height. Rvk relates to valley depth below the surface mean height. In some embodiments, prior to break in, both Rpk and Rvk are at least about 2 μm. In some embodiments, prior to break in, both Rpk and Rvk are at least about 3 μm. Rvk may remain nearly the same or even increase after break-in. Rpk, on the other hand, may be reduced. In some embodiments, after break-in, the Rpk is less than about 3 μm. In some embodiments, after break-in, the Rpk is less than about 2 μm. In some embodiments, after break-in, the Rpk is half or less than half Rvk. In some embodiments, after break-in, the Rpk is one fourth or less than one fourth Rvk.

The coating 211 can be applied to any type of gun. Examples of guns that may be coated include, without limitation, semi-automatic handguns, e.g., a Colt 1911 style pistol, a semi-automatic rifle, e.g., an AR-15, a machine gun such as an M249 light machine gun, an M60 machine gun, or a Browning .50 caliber heavy machine gun, a Gatling-style rotary cannon, e.g., an M61 Vulcan or even a heavier gun. In some embodiments, the gun has a gas-powered reloading mechanism.

Figure 5:
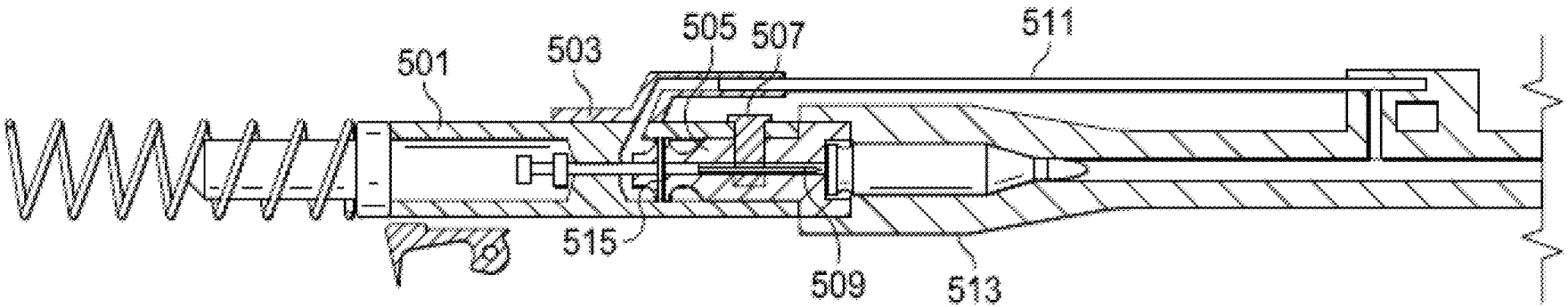
FIG. 5 illustrates parts of an AR-15, some of which may be coated in accordance the present teachings.

FIG. 5 illustrates some parts of an AR-15 that are associated with the gas reloading mechanism. These parts include a bolt carrier 501, a gas key 503, a bolt 505, a bolt cam pin 507, a firing pin 509, a gas tube 511, a barrel 513, and a bolt ring 515. Any or all of these parts may receive the coating 211. During operation of the gas reloading mechanism, the following pairs of parts move in telescoping relationship: the bolt carrier 501 and the bolt ring 515, the bolt carrier 501 and the bolt 505, the bolt carrier 501 and a receiver (not shown), the bolt carrier 501 and the firing pin 509, the firing pin 509 and the bolt 505, the gas key 503 and the gas tube 511, and the bolt 505 and the barrel 513. There is also sliding movement between bolt cam pin 507 and the bolt 505 and between the bolt cam pin 507 and the bolt carrier 501.

The bolt carrier 501, the bolt 505, and the bolt cam pin 507 of an AR-15 were given a coating 211 according to the present teachings. The coating 211 varied in thickness from a minimum of 50 μm to a maximum of 750 μm, the maximum occurring on the rails (not shown) of the bolt carrier 501.

Figure 6:
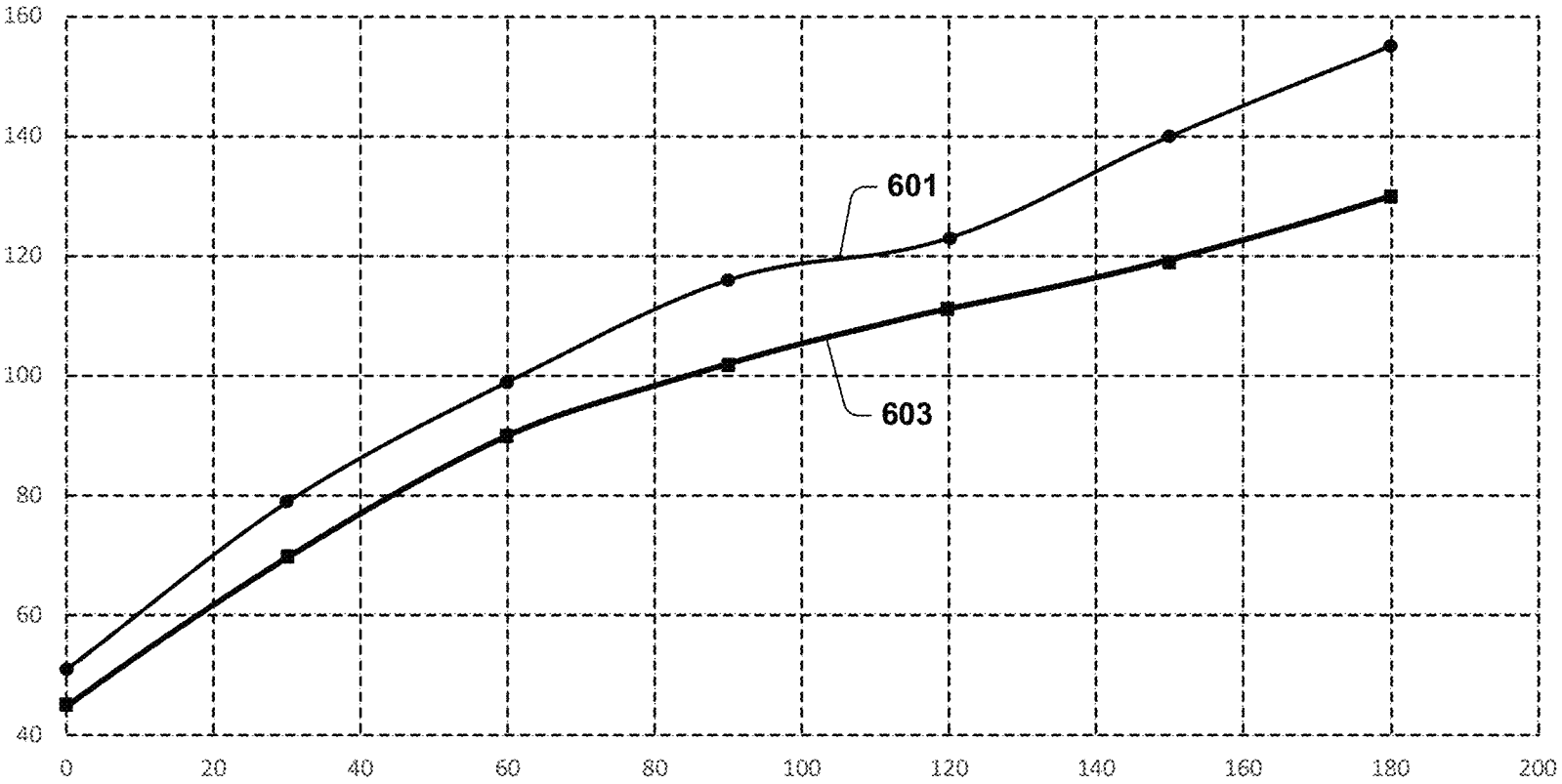
FIG. 6 is a plot showing an effect of a coating according to the present teachings on operating temperature

FIG. 6 compares the bolt and bolt carrier temperature of an AR-15 with the coating to one lacking the coating. The guns were fired one every second until the magazine was emptied. Firing continued about 15 seconds later after a magazine exchange. The plot 601 shows temperature as a function of rounds fired for the uncoated AR-15 and the plot 603 shows temperature as a function of rounds fired for the AR-15 with coated parts. The temperatures were substantially lower for the coated gun.

Figure 7:
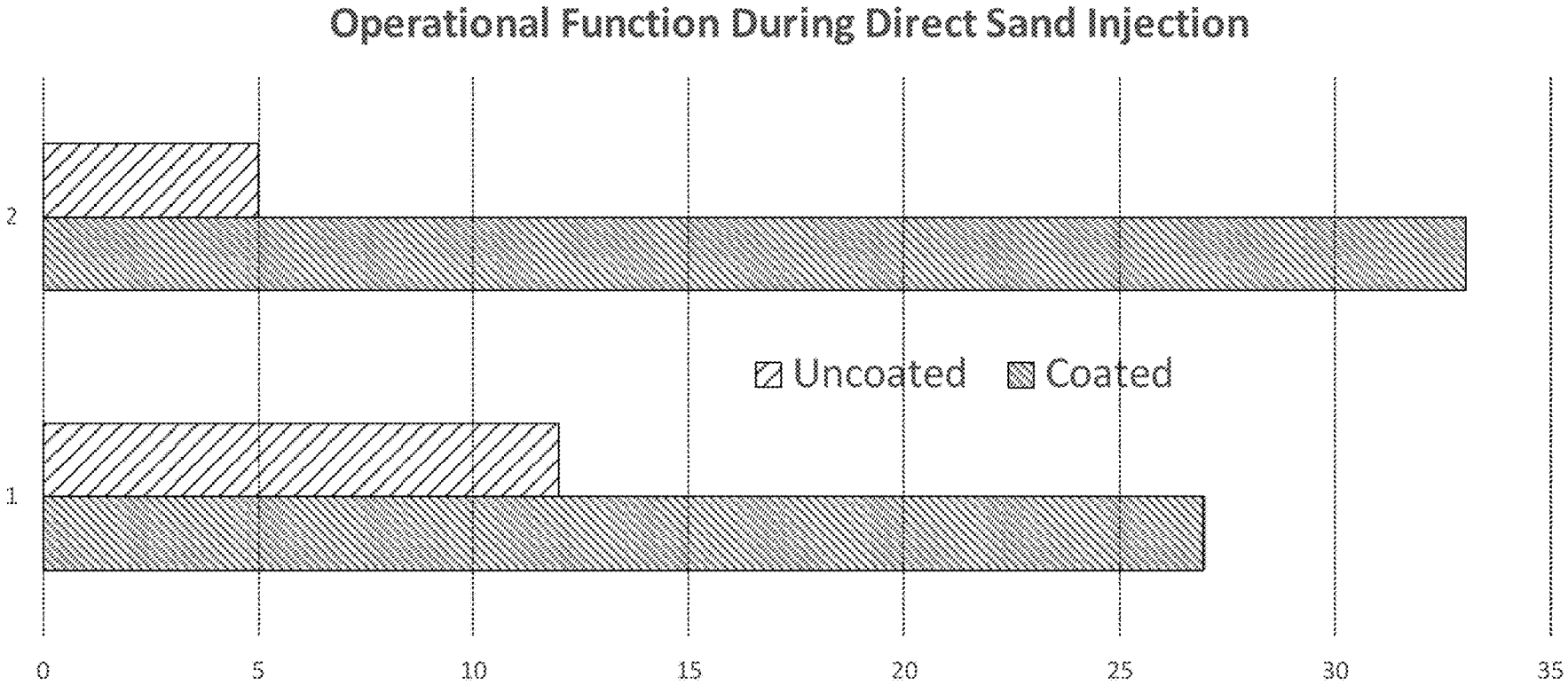
FIG. 7 is a plot showing an effect of a coating according to the present teachings on a jamming rate.

FIG. 7 is a bar chart showing the results of two trials in which a sand injection machine was used to shoot sand into the ejection port of the coated and uncoated AR-15s. In each case, firing continued until the gun jammed. Between trials, the guns were disassembled, cleaned, and lubricated. In both trials, the coated weapon was able to fire many more rounds before jamming.

The components and features of the present disclosure have been shown and/or described in terms of certain embodiments and examples. While a particular component or feature, or a broad or narrow formulation of that component or feature, may have been described in relation to only one embodiment or one example, all components and features in either their broad or narrow formulations may be combined with other components or features to the extent such combinations would be recognized as logical by one of ordinary skill in the art.

The invention claimed is:

1. A gun, comprising:

a first metal part and a second metal part that slide past one another; and a coating over a surface of the first metal part; wherein the coating comprises a porous upper layer;

the porous upper layer comprises a thermoset polymer and a filler; and the porous upper layer has the property of taking up oil, retaining the oil, and expressing some of the oil under stresses induced by operating the gun; and wherein the coating further comprises a lower layer, and the lower layer has a porosity of 5% or less.

2. The gun of claim 1, wherein the porous upper layer is operative to reabsorb some of the expressed oil after the stresses are relieved.

3. The gun of claim 1, wherein the coating has a thickness of at least 250 μm.

4. The gun of claim 1, wherein a surface of the coating has a Reduced Valley Depth (Rvk) of 2 μm or more.

5. The gun of claim 1, wherein a surface of the coating has a negative skewness indicating that valleys in the surface contribute more to a roughness of the surface than do peaks of the surface.

6. The gun of claim 1, wherein:

the coating has a Reduced Peak Height (Rpk) and a Reduced Valley Depth (Rvk), which are parameters related to roughness of a surface of the coating; and the Rpk is half or less the Rvk.

7. The gun of claim 1, wherein the first metal part and the second metal part have a telescoping relationship.

8. The gun of claim 1, wherein the first metal part and the second metal part are selected from the group consisting of a bolt, a bolt carrier, a receiver, and a firing pin.

9. The gun of claim 1, wherein the porous upper layer has an interconnectivity above a percolation threshold.

10. The gun of claim 1, wherein:

the porous upper layer comprises particles that individually comprise the thermoset polymer and the filler;

the particles are adhered to one-another; and spaces between the particles provide the porous upper layer with porosity.

11. The gun of claim 10, wherein the filler is a solid lubricant and is present within the particles in an amount that is from 15% to 40% by volume.

12. The gun of claim 1, wherein the coating initially creates an interference fit between the first metal part and the second metal part.

13. A gun, comprising:

a first metal part and a second metal part that slide past one another; and a coating over a surface of the first metal part;

wherein the coating comprises a porous upper layer;

the porous upper layer comprises a thermoset polymer and a filler; and the porous upper layer has the property of taking up oil, retaining the oil, and expressing some of the oil under stresses induced by operating the gun; and wherein the coating is a product of a processes comprising:

applying a liquid primer over the surface, wherein the liquid primer comprises a second thermosetting resin;

applying a powder of particles individually comprising a thermosetting resin and the filler over the liquid primer prior to drying or curing the liquid primer; and curing the powder and the liquid primer;

wherein the powder forms the porous upper layer and the second thermosetting resin forms a polymer matrix underneath the porous upper layer.

14. A gun, comprising:

a first metal part and a second metal part that slide past one another; and a coating over a surface of the first metal part;

wherein the coating comprises a porous upper layer;

the porous upper layer comprises a thermoset polymer and a filler; and the porous upper layer has the property of taking up oil, retaining the oil, and expressing some of the oil under stresses induced by operating the gun; and wherein the coating further comprises a lower layer comprising a second thermoset polymer.

* * * * *